US011040373B2

(12) United States Patent
Rush

(10) Patent No.: US 11,040,373 B2
(45) Date of Patent: Jun. 22, 2021

(54) SLIDING DRAWER SIFTER APPARATUS

(71) Applicant: Kimberli Rush, Pahrump, NV (US)

(72) Inventor: Kimberli Rush, Pahrump, NV (US)

( * ) Notice: Subject to any disclaimer, the term of this patent is extended or adjusted under 35 U.S.C. 154(b) by 61 days.

(21) Appl. No.: 16/453,360

(22) Filed: Jun. 26, 2019

(65) Prior Publication Data

US 2020/0406302 A1 Dec. 31, 2020

(51) Int. Cl.

| | |
|---|---|
| ***B07B 13/04*** | (2006.01) |
| ***B07B 1/12*** | (2006.01) |
| ***B07B 1/46*** | (2006.01) |
| ***B07B 1/30*** | (2006.01) |

(52) U.S. Cl.

CPC ..... *B07B 13/04* (2013.01); *B07B 1/12* (2013.01); *B07B 1/30* (2013.01); *B07B 1/469* (2013.01); *B07B 2201/02* (2013.01); *B07B 2201/04* (2013.01)

(58) Field of Classification Search

CPC .. B07B 13/04; B07B 1/12; B07B 1/04; B07B 1/469; B07B 2201/04; B07B 1/4663; B07B 13/08; B07B 2220/00

USPC ..... 209/372, 373, 374, 659

See application file for complete search history.

(56) References Cited

U.S. PATENT DOCUMENTS

| | | | | |
|---|---|---|---|---|
| 740,194 | A * | 9/1903 | Smith | F24B 15/007 209/342 |
| 1,541,687 | A | 6/1925 | Cory | |
| 4,250,537 | A | 2/1981 | Roegner | |
| 5,341,939 | A | 8/1994 | Aitchison | |
| 5,392,931 | A * | 2/1995 | Jones | B07B 1/12 209/674 |
| 5,429,248 | A | 7/1995 | La Gigan | |
| 6,793,355 | B1 | 9/2004 | Leung | |
| 8,672,496 | B2 | 3/2014 | O'Kane | |
| 9,999,795 | B1 | 6/2018 | Jarosz | |
| 2012/0297671 | A1 | 11/2012 | Sexton | |
| 2014/0048456 | A1 | 2/2014 | Adams, Sr. | |
| 2014/0291216 | A1 | 10/2014 | Brunone | |
| 2015/0021238 | A1 | 1/2015 | Gandhi | |

FOREIGN PATENT DOCUMENTS

| | | | |
|---|---|---|---|
| CN | 109433577 | A * | 3/2019 |

* cited by examiner

*Primary Examiner* — Charles A Fox
*Assistant Examiner* — Jessica L Burkman

(57) ABSTRACT

A sliding drawer sifter apparatus for sorting plant buds by size includes a frame having a set of drawers comprising a top drawer, a middle drawer, and a bottom draw. Each of the set of drawers has a handle and an inner lip. A set of sifter grates each has a grate perimeter selectively engageable with the inner lip of each of the drawers and a grate body coupled within the grate perimeter. The set of sifter grates comprises a top grate, a middle grate, and a bottom grate. The grate body of the bottom grate is finer than the grate body of the middle grate. The grate body of the middle grate is finer than the grate body of the top grate. The top grate, the middle grate, and the bottom grate are configured to sort progressively smaller plant buds into the set of drawers.

8 Claims, 5 Drawing Sheets

SLIDING DRAWER SIFTER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to sifters and more particularly pertains to a new sifter for sorting plant buds by size.

BRIEF SUMMARY OF THE INVENTION

An embodiment of the disclosure meets the needs presented above by generally comprising a frame having a front perimeter, a back perimeter, an upper perimeter, a lower perimeter, a left perimeter, and a right perimeter. The frame has a top divider perimeter and a bottom divider perimeter each lying in a plane parallel with a plane of the upper perimeter. A set of drawers each have a front side separated from a back side, a left side separated from a right side, a bottom side, and an open top side forming a drawer cavity. An inner lip is coupled to each of the front side, the left side, the back side, and the right side within the drawer cavity. A handle is coupled to the front side. The set of drawers comprises a top drawer, a middle drawer, and a bottom drawer. The top drawer is slidably engageable with the frame between the top divider perimeter and the upper perimeter. The middle drawer is slidably engageable with the frame between the bottom divider perimeter and the top divider perimeter. The bottom drawer is slidably engageable with the frame between the bottom divider perimeter and the lower perimeter. A set of sifter grates each has a grate perimeter selectively engageable with the inner lip of each of the drawers and a grate body coupled within the grate perimeter. The set of sifter grates comprises a top grate, a middle grate, and a bottom grate for each of the top drawer, the middle drawer, and the bottom drawer, respectively. The grate body of the bottom grate is finer than the grate body of the middle grate. The grate body of the middle grate is finer than the grate body of the top grate. The top grate, the middle grate, and the bottom grate are configured to sort progressively smaller plant buds into the top drawer, the middle drawer, and the bottom drawer, respectively.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
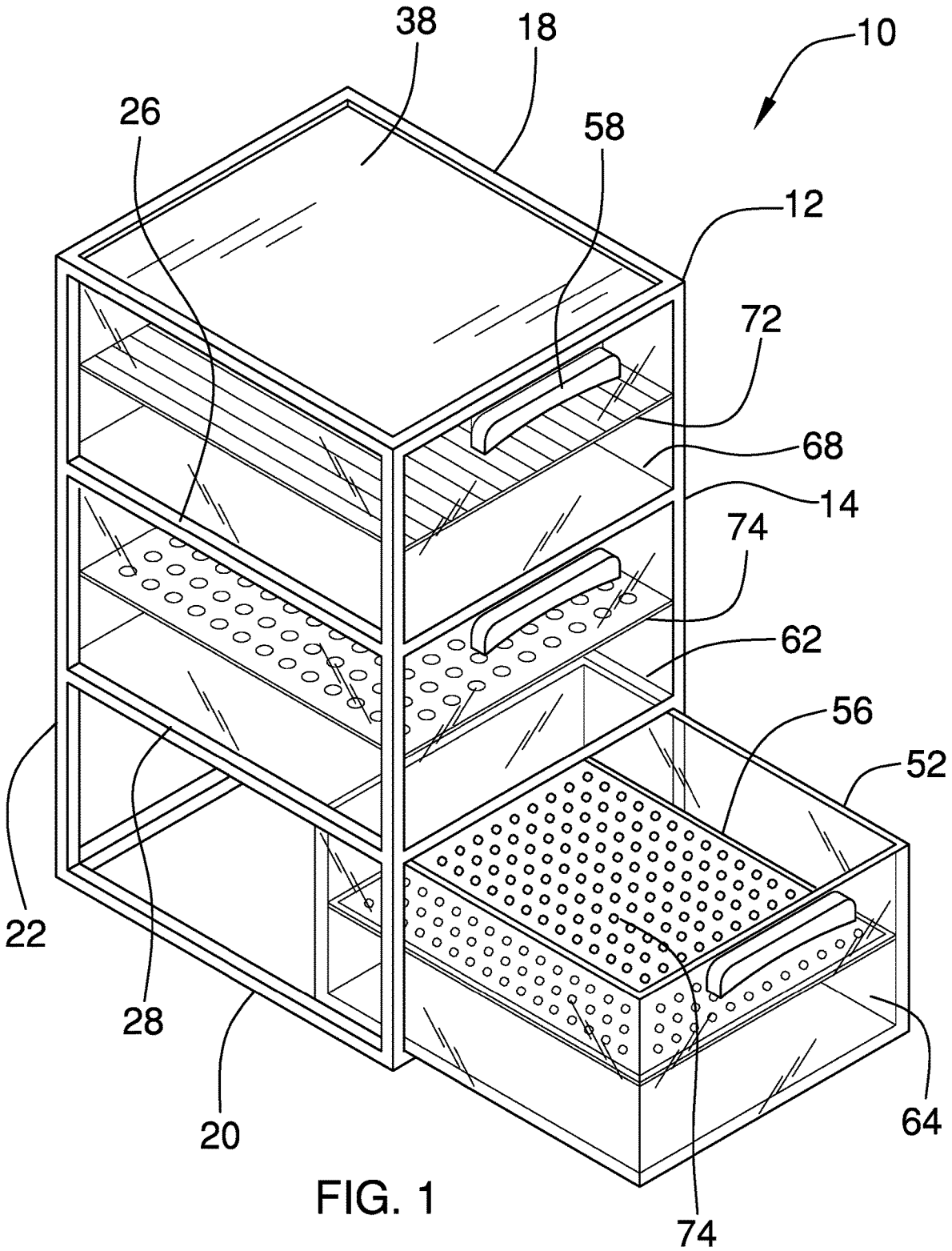
FIG. 1 is an isometric view of a sliding drawer sifter apparatus according to an embodiment of the disclosure.
Figure 2:
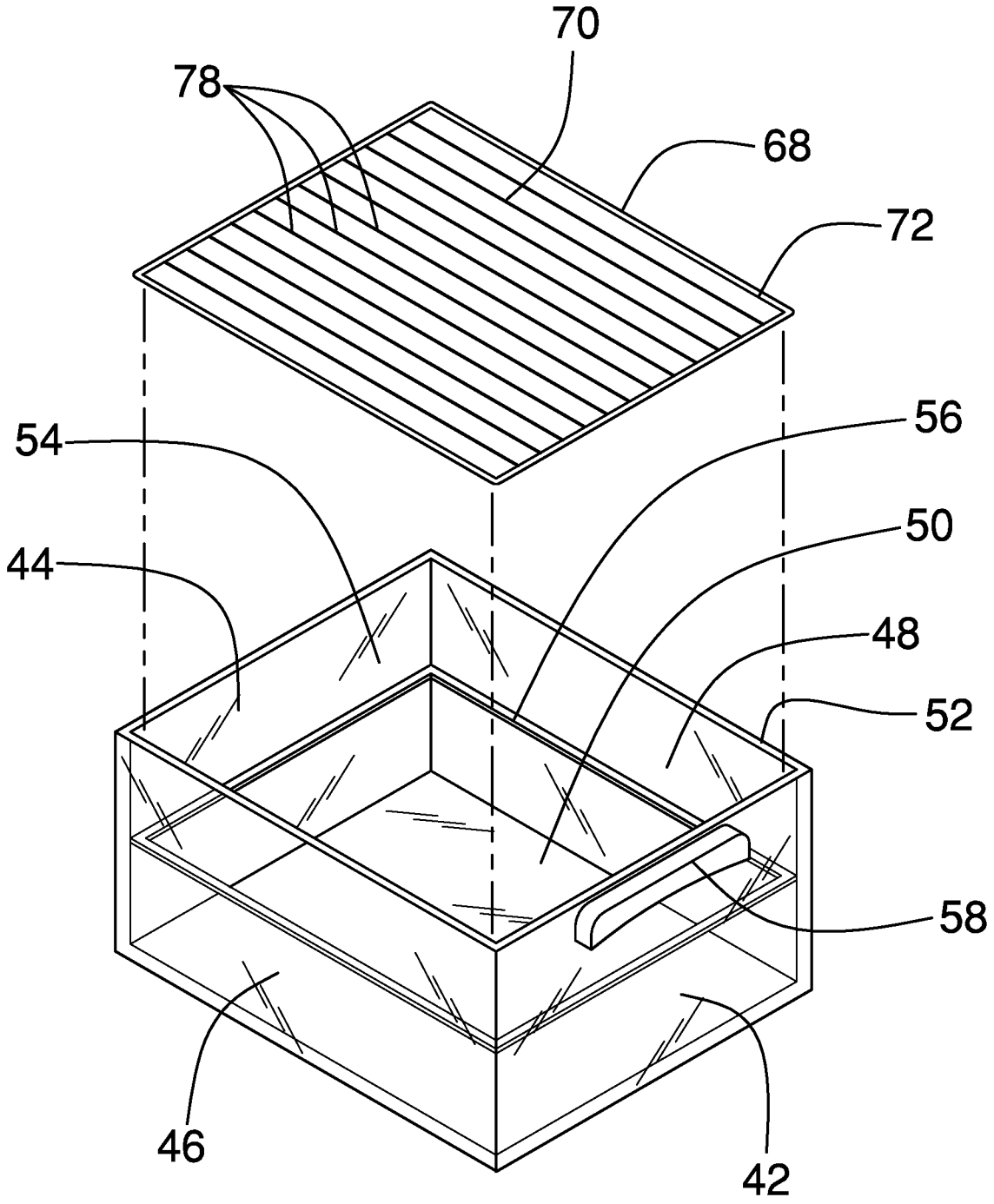
FIG. 2 is an isometric view of an embodiment of the disclosure.
Figure 3:
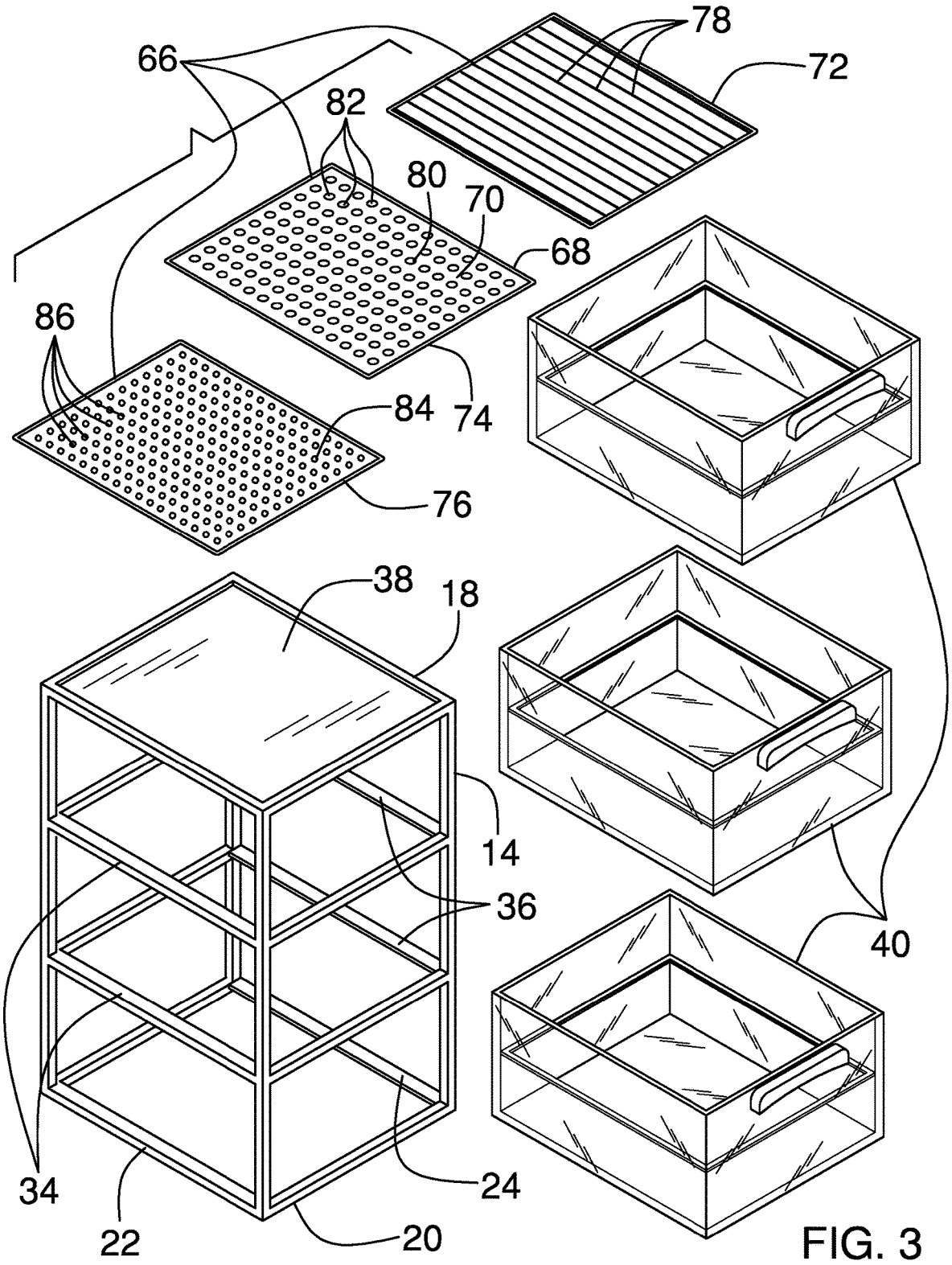
FIG. 3 is an exploded view of an embodiment of the disclosure.
Figure 4:
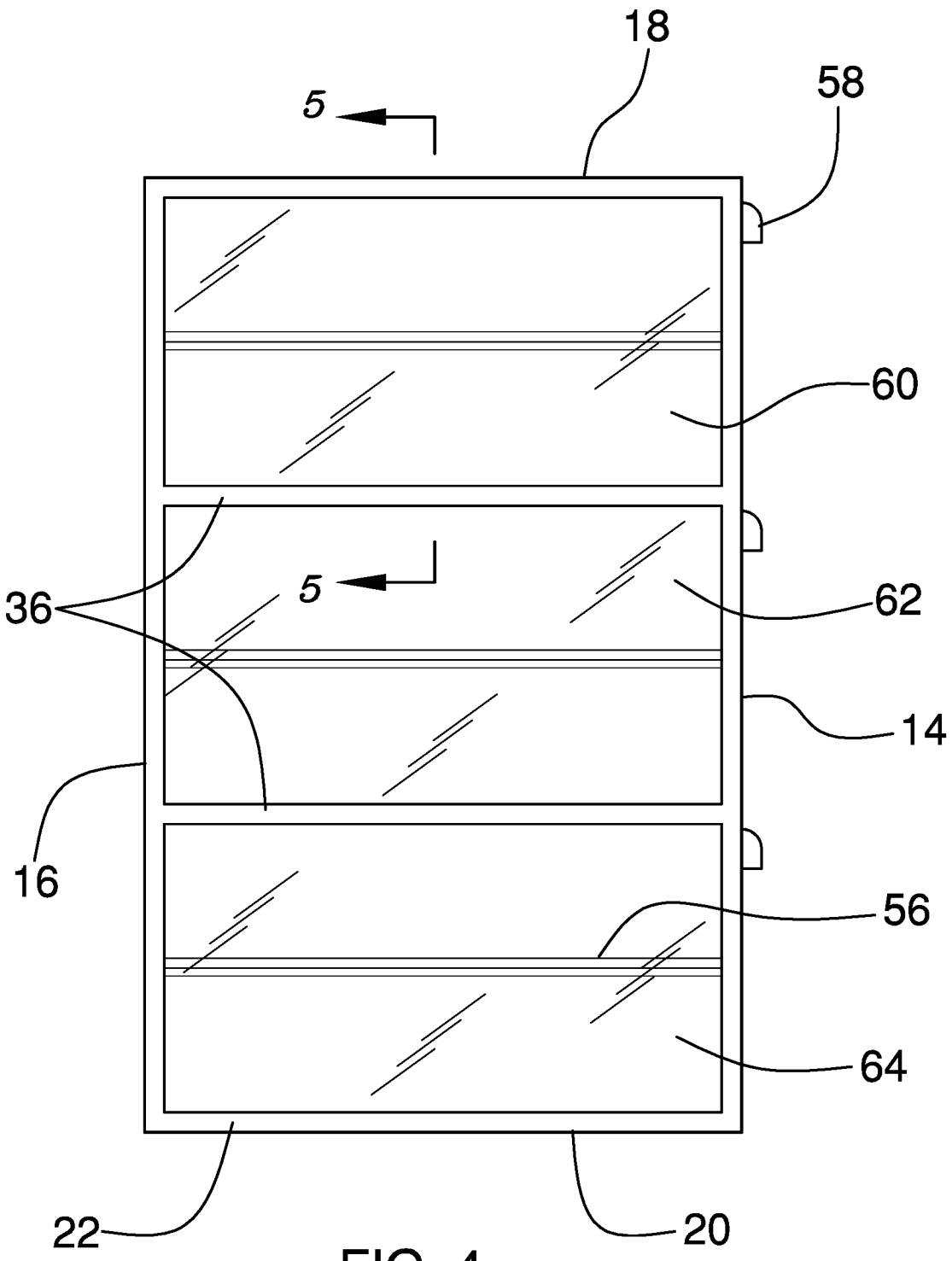
FIG. 4 is a side elevation view of an embodiment of the disclosure.
Figure 5:
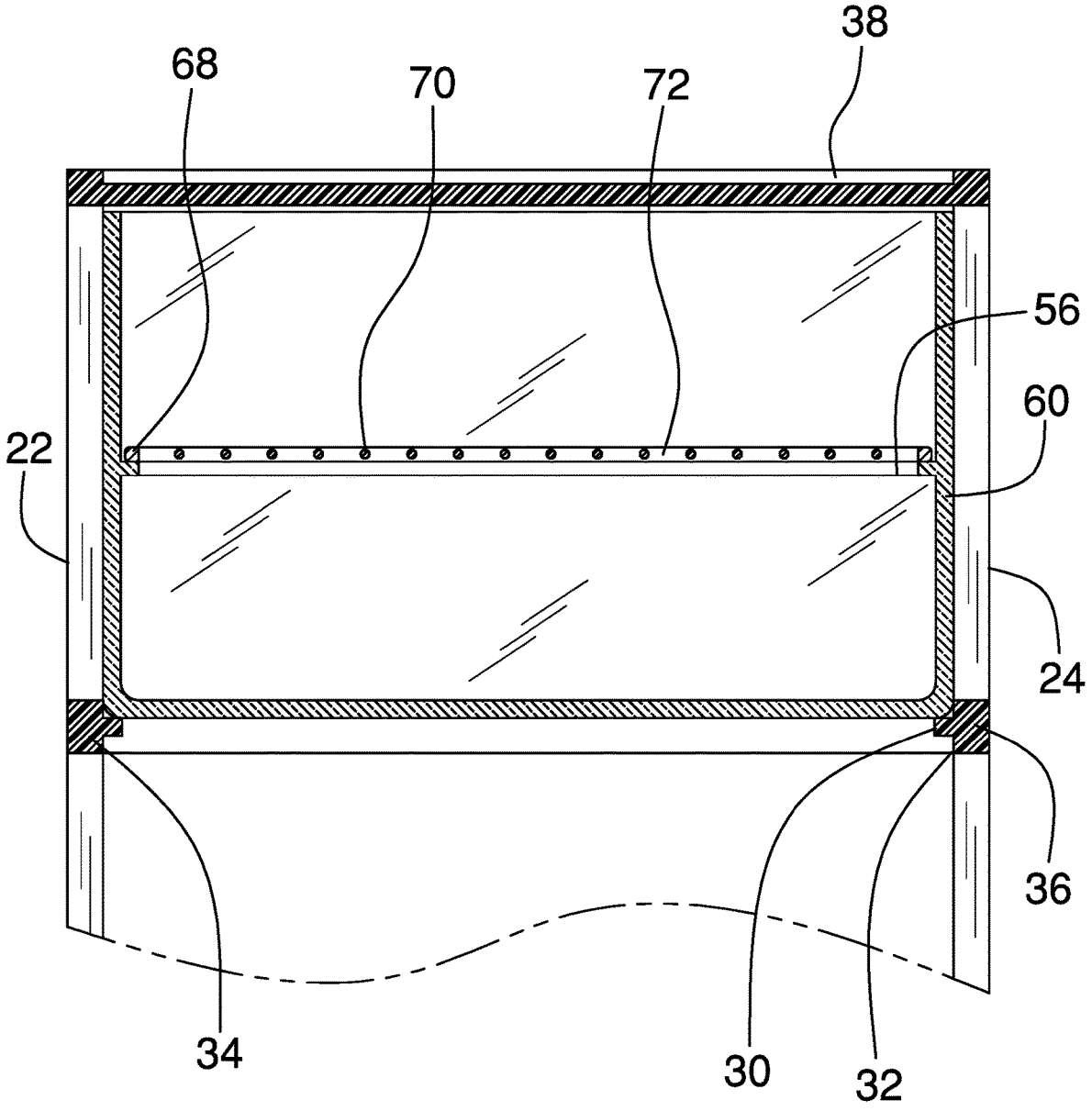
FIG. 5 is a cross-sectional view along the line 5-5 of FIG. 4 of an embodiment of the disclosure.

With reference now to the drawings, and in particular to FIGS. 1 through 5 thereof, a new sifter embodying the principles and concepts of an embodiment of the disclosure and generally designated by the reference numeral 10 will be described.

As best illustrated in FIGS. 1 through 5, the sliding drawer sifter apparatus 10 generally comprises a frame 12 having a front perimeter 14, a back perimeter 16, an upper perimeter 18, a lower perimeter 20, a left perimeter 22, and a right perimeter 24. The frame 12 has a top divider perimeter 26 and a bottom divider perimeter 28 each lying in a plane parallel with a plane of the upper perimeter 18. The top divider perimeter 26 and the bottom divider perimeter 28 are evenly spaced between the upper perimeter 18 and the lower perimeter 20. Each of the top divider perimeter 26 and the bottom divider perimeter 28 has an inner ridge 30 extending from an inner face 32 of each of a left side segment 34 and a right side segment 36. The left side segment 34 and the right side segment 36 of each of the top divider perimeter 26 and the bottom divider perimeter 28 extend within the left perimeter 22 and the right perimeter 24. A top cover 38 is coupled to the frame 12 within the upper perimeter 18. The top cover 38 is transparent. Each of a set of drawers 40 is transparent and has a front side 42 separated from a back side 44, a left side 46 separated from a right side 48, a bottom side 50, and an open top side 52 forming a drawer cavity 54. An inner lip 56 is coupled to each of the front side 42, the left side 46, the back side 44, and the right side 48 within the drawer cavity 54. The inner lip 56 lies in a plane parallel to a plane of the bottom side 50 and is medially disposed between the bottom side 50 and the open top side 52. A handle 58 is coupled to the front side 42.

The set of drawers 40 comprises a top drawer 60, a middle drawer 62, and a bottom drawer 64. The top drawer 60 is slidably engageable with the frame 12 between the top divider perimeter 26 and the upper perimeter 18. The middle drawer 62 is slidably engageable with the frame 12 between the bottom divider perimeter 28 and the top divider perimeter 26. The bottom drawer 64 is slidably engageable with the frame 12 between the bottom divider perimeter 28 and the lower perimeter 20. Each of a set of sifter grates 66 has a grate perimeter 68 selectively engageable with the inner lip 56 of each of the drawers 40 and a grate body 70 coupled within the grate perimeter 68. The set of sifter grates 66 comprises a top grate 72, a middle grate 74, and a bottom grate 76 for each of the top drawer 60, the middle drawer 62, and the bottom drawer 64, respectively. The grate body 70 of the bottom grate 76 is finer than the grate body 70 of the middle grate 74. The grate body 70 of the middle grate 74 is finer than the grate body 70 of the top grate 72. The grate body 70 of the top grate 72 comprises a plurality of parallel rods 78. The grate body 70 of the middle grate 74 comprises a middle sheet 80 having a plurality of middle apertures 82 extending therethrough. The grate body 70 of the bottom grate 76 comprises a bottom sheet 84 having a plurality of bottom apertures 86 extending therethrough. Each of the plurality of bottom apertures 86 has a diameter smaller than a diameter of each of the plurality of middle apertures 82. The top grate 72, the middle grate 74, and the bottom grate 76 are configured to sort progressively smaller plant buds into the top drawer 60, the middle drawer 62, and the bottom drawer 64, respectively.

In use, the user places plant buds into the top drawer 60 on the top grate 72. The buds that pass through the top grate 72 are placed into the middle drawer 62 onto the middle grate 74. The buds that pass through the middle grate 74 are then placed into the bottom drawer 64 onto the bottom grate 76. The bottom grate 76 then sifts out the smallest particles into the bottom drawer 64.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sliding drawer sifter apparatus comprising:

a frame, the frame having a front perimeter, a back perimeter, an upper perimeter, a lower perimeter, a left perimeter, and a right perimeter, the frame having a top divider perimeter and a bottom divider perimeter each lying in a plane parallel with a plane of the upper perimeter;

a set of drawers, each of the drawers having a front side separated from a back side, a left side separated from a right side, a closed bottom side, and an open top side forming a drawer cavity, an inner lip being coupled to each of the front side, the left side, the back side, and the right side within the drawer cavity, the inner lip lying in a plane parallel to a plane of the bottom side, the inner lip being medially disposed between the bottom side and the open top side, a handle being coupled to the front side, the set of drawers comprising a top drawer, a middle drawer, and a bottom drawer, the top drawer being slidably engageable with the frame between the top divider perimeter and the upper perimeter, the middle drawer being slidably engageable with the frame between the bottom divider perimeter and the top divider perimeter, the bottom drawer being slidably engageable with the frame between the bottom divider perimeter and the lower perimeter; and a set of sifter grates, each of the sifter grates having a grate perimeter selectively engageable with the inner lip of each of the drawers and a grate body coupled within the grate perimeter, the set of sifter grates comprising a top grate, a middle grate, and a bottom grate for each of the top drawer, the middle drawer, and the bottom drawer, respectively, the grate body of the bottom grate being finer than the grate body of the middle grate, the grate body of the middle grate being finer than the grate body of the top grate, the top grate, the middle grate, and the bottom grate being configured to sort progressively smaller plant buds into the top drawer, the middle drawer, and the bottom drawer, respectively.

2. The sliding drawer sifter apparatus of claim 1 further comprising the grate body of the top grate comprising a plurality of parallel rods, the grate body of the middle grate comprising a middle sheet having a plurality of middle apertures extending therethrough, and the grate body of the bottom grate comprising a bottom sheet having a plurality of bottom apertures extending therethrough, each of the plurality of bottom apertures having a diameter smaller than a diameter of each of the plurality of middle apertures.

3. The sliding drawer sifter apparatus of claim 1 further comprising a top cover coupled to the frame, the top cover being coupled within the upper perimeter.

4. The sliding drawer sifter apparatus of claim 3 further comprising the top cover being transparent.

5. The sliding drawer sifter apparatus of claim 1 further comprising each of the set of drawers being transparent.

6. The sliding drawer sifter apparatus of claim 1 further comprising the top divider perimeter and the bottom divider perimeter being evenly spaced between the upper perimeter and the lower perimeter.

7. The sliding drawer sifter apparatus of claim 1 further comprising each of the top divider perimeter and the bottom divider perimeter having an inner ridge extending from an inner face of each of a left side segment and a right side segment, the left side segment and the right side segment of each of the top divider perimeter and the bottom divider perimeter extending within the left perimeter and the right perimeter.

8. A sliding drawer sifter apparatus comprising:

a frame, the frame having a front perimeter, a back perimeter, an upper perimeter, a lower perimeter, a left perimeter, and a right perimeter, the frame having a top divider perimeter and a bottom divider perimeter each lying in a plane parallel with a plane of the upper perimeter, the top divider perimeter and the bottom divider perimeter being evenly spaced between the upper perimeter and the lower perimeter, each of the top divider perimeter and the bottom divider perimeter having an inner ridge extending from an inner face of each of a left side segment and a right side segment, the left side segment and the right side segment of each of the top divider perimeter and the bottom divider perimeter extending within the left perimeter and the right perimeter;

a top cover coupled to the frame, the top cover being coupled within the upper perimeter, the top cover being transparent;

a set of drawers, each of the drawers being transparent and having a front side separated from a back side, a left side separated from a right side, a closed bottom side, and an open top side forming a drawer cavity, an inner lip being coupled to each of the front side, the left side, the back side, and the right side within the drawer cavity, the inner lip lying in a plane parallel to a plane of the bottom side and being medially disposed between the bottom side and the open top side, a handle being coupled to the front side, the set of drawers comprising a top drawer, a middle drawer, and a bottom drawer, the top drawer being slidably engageable with the frame between the top divider perimeter and the upper perimeter, the middle drawer being slidably engageable with the frame between the bottom divider perimeter and the top divider perimeter, the bottom drawer being slidably engageable with the frame between the bottom divider perimeter and the lower perimeter; and a set of sifter grates, each of the sifter grates having a grate perimeter selectively engageable with the inner lip of each of the drawers and a grate body coupled within the grate perimeter, the set of sifter grates comprising a top grate, a middle grate, and a bottom grate for each of the top drawer, the middle drawer, and the bottom drawer, respectively, the grate body of the bottom grate being finer than the grate body of the middle grate, the grate body of the middle grate being finer than the grate body of the top grate, the grate body of the top grate comprising a plurality of parallel rods, the grate body of the middle grate comprising a middle sheet having a plurality of middle apertures extending therethrough, and the grate body of the bottom grate comprising a bottom sheet having a plurality of bottom apertures extending therethrough, each of the plurality of bottom apertures having a diameter smaller than a diameter of each of the plurality of middle apertures, the top grate, the middle grate, and the bottom grate being configured to sort progressively smaller plant buds into the top drawer, the middle drawer, and the bottom drawer, respectively.

* * * * *